US006135841A

United States Patent [19]

Mackey

[11] Patent Number: 6,135,841

[45] Date of Patent: Oct. 24, 2000

[54] USE OF PRINTER HEAD TECHNIQUES TO FORM PIXEL ASSEMBLIES IN FIELD-EMISSION DISPLAYS

[75] Inventor: Bob L. Mackey, San Jose, Calif.

[73] Assignee: Candescent Technologies Corporation, San Jose, Calif.

[21] Appl. No.: 09/138,949

[22] Filed: Aug. 24, 1998

[51] Int. Cl.[7] ..... H01J 9/227

[52] U.S. Cl. ..... 445/52; 427/68

[58] Field of Search ..... 445/52, 24; 427/68

[56] References Cited

U.S. PATENT DOCUMENTS

| | | | |
|---|---|---|---|
| 4,960,658 | 10/1990 | Ikeno et al. | 430/7 |
| 5,572,041 | 11/1996 | Betsui et al. | 257/10 |
| 5,907,377 | 5/1999 | Nishida et al. | 427/68 |
| 5,921,836 | 7/1999 | Nanto et al. | 445/24 |

*Primary Examiner*—Kenneth J. Ramsey

*Attorney, Agent, or Firm*—Wagner Murabito & Hao LLP

[57] ABSTRACT

A method for fabricating a pixel assembly on a faceplate of a display device, such as a field-emission display device. In one embodiment of the present invention, an application device is aligned over a pixel assembly on the faceplate. The present invention dispenses a specific amount of a substance into the pixel assembly such that the substance is dispensed primarily into the pixel assembly and such that the substance is not substantially dispensed outside of the pixel assembly. The present invention dispenses the substance into the pixel assembly such that the substance is not dispensed on a top surface of a matrix structure, where the matrix structure separates rows and columns of adjacent pixel assemblies. In one embodiment, the substance is dispensed into the pixel assembly from a printer head (e.g., an ink-jet printer head) adapted to dispense the substance. The substance is selected from a group consisting of: a color filter material, a phosphor material, a wetting material, a lacquer material, and a reflective layer material.

25 Claims, 8 Drawing Sheets

USE OF PRINTER HEAD TECHNIQUES TO FORM PIXEL ASSEMBLIES IN FIELD-EMISSION DISPLAYS

FIELD OF THE INVENTION

The present claimed invention relates to the field of display devices, particularly field-emission display devices. More particularly, the present claimed invention relates to the manufacture of pixel assemblies on the faceplate of a field-emission display device.

BACKGROUND ART

The inside surface of the faceplate of a field-emission display device (also referred to as a flat panel display) contains pixels. For color displays, each pixel is typically separated into three pixel assemblies, each pixel assembly containing one of three colors (e.g., red, blue or green) of phosphor material. The following discussion can also be applied to monochrome displays where all pixel assemblies have the same color of phosphor (including white) rather than pixel assemblies of different colors. The technique described below can be applied to plasma, cathode ray tube and other display devices as well as field-emission display devices.

For the case of a color field-emission display device, electrons are directed from an electron emitter into each pixel assembly to excite the phosphor therein and cause it to emit light. Light generated in this fashion travels either toward the viewer through the faceplate or away from the viewer. A thin coating of reflective material, typically aluminum, can be layered across the rear surfaces of the pixel assemblies to reflect light toward the viewer. The reflective layer can also function as an anode to attract the electrons emitted by the electron emitters. When used, the reflective layer is relatively thin, on the order of 300–500 Angstroms, to enable electrons to pass from the electron source to the phosphor material without losing a significant amount of energy.

The pixel assemblies are typically separated into rows and columns by an opaque mesh-like structure commonly referred to as a black matrix. The black matrix functions to increase the contrast of the display by sharply demarcating a pixel assembly of one color from a pixel assembly of another color and by absorbing ambient light. In addition, by separating pixel assemblies, a three-dimensional black matrix prevents electrons directed at one pixel assembly from being "back-scattered" and striking another pixel assembly, thus helping to maintain a field-emission display device with sharp resolution. The black matrix is also used as a base on which to locate structures such as, for example, support walls. Another important function of the black matrix is to provide a surface to which the reflective layer of aluminum can adhere.

In one embodiment of the prior art field-emission display device, a color filter material is also incorporated in each pixel assembly between the phosphor material and the faceplate in order to enhance the visual display by transmitting only the desired wavelength and absorbing the rest. This color filter may or may not be incorporated in the display, depending on the manufacturing cost and contrast requirements.

With reference to Prior Art FIG. 1, a top view of the inside surface of faceplate 105 of a field-emission display device is illustrated. Black matrix 110 separates the faceplate into a plurality of rows and columns of pixel assemblies 115. A layer each of color filter material and of phosphor material are contained within each of pixel assemblies 115.

With reference to Prior Art FIGS. 2A and 2B, one prior art method of forming a pixel assembly and applying the reflective layer of aluminum to faceplate 105 of a field-emission display device is described. Black matrix 110 and pixel assembly 115 are shown in cross-sectional view. For clarity, a single pixel assembly 115 is shown with two side walls formed by black matrix 110. In actuality, a plurality of pixel assemblies exist, each surrounded on four sides by the black matrix, some sides of which may be taller than others.

With reference first to FIG. 2A, a layer of a selected color (e.g., red, blue or green) of color filter material 220 is deposited into pixel assembly 115. Next, a layer of a selected color of phosphor material 230 is deposited into pixel assembly 115. Then, a layer of lacquer 240 is applied, followed by deposition of the reflective layer.

In one embodiment of the prior art in which a color filter material is used, the selected color of color filter material 220 or phosphor material 230 is spread entirely over all pixel assemblies 115; for example, red phosphor material is spread over all pixel assemblies, including those pixel assemblies in which the red phosphor material is not intended to remain. Then, a photolithographic process is applied in a specific pattern to the rows and columns of pixel assemblies so that only the color filter material or the phosphor material that is intended to remain in the pixel assemblies is exposed to the process; in the example, only the pixel assemblies where the red phosphor material is to remain are exposed to the photolithographic process. The color filter material or the phosphor material exposed to the photolithographic process hardens sufficiently through photo-polymerization while the unexposed material does not. The unexposed material is then washed away, leaving behind only the selected color. This process is repeated for each of the colors of color filter material or phosphor material remaining to be applied until each pixel assembly 115 contains a layer of color filter material 220 and a layer of phosphor material 230.

The prior art method described above is problematic because it results in a significant amount of color filter material and phosphor material being wasted. In general, approximately two-thirds of the color filter material and phosphor material is washed away in each step of the application process. In addition, the prior art process is time-consuming because it employs a number of repetitive steps (e.g., six steps) to apply each color of color filter and phosphor material.

In other prior art methods, processes are employed to selectively apply the different colors of color filter material and phosphor material only into the pixel assemblies where the material is intended to remain. These other prior art methods apply only one color of one material at a time. These other methods include the following: a process in which a dust of the material is applied to a patterned sticky layer, a process in which the material is suspended in an electrolytic bath and an electric field is applied causing the material to be attracted to a patterned glass, a process in which electrostatic fields are used to cause a dry powder of the material to be attracted to a patterned charged substrate, and a process in which the material is screen-printed onto a substrate in a pattern. These alternative prior art methods alleviate the wastage issue; however, they are problematic because they still require multiple process steps, one step for each color, and so remain time-consuming.

Continuing with reference to FIG. 2A, in the next step of the aforementioned prior art method, lacquer material 240 is deposited over the entire surface of phosphor material 230 and black matrix 110. In one prior art method known as the float lacquer process, faceplate 105 is immersed in water. A film of lacquer material is formed on the surface of the water. The water is then drained and the lacquer material settles onto faceplate 105, including phosphor material 230 and black matrix 110, as the water level is reduced. In another prior art method known as the spray lacquer method, water is sprayed over the entire surface of faceplate 105, and then a layer of lacquer material is applied over the entire surface of phosphor material 230 and black matrix 110. As the water evaporates, the lacquer material settles onto faceplate 105.

The individual particles of phosphor material 230 are irregularly shaped. Hence, the water provides a smooth surface over which lacquer material 240 is applied to create a smooth lacquer surface. Thus, when the water is drained or evaporated away, lacquer material 240 in turn forms a smooth surface over the particles of phosphor material 230. Aluminum reflective layer 250 is then deposited over lacquer material 240. The smooth surface of lacquer material 240 results in a mirror finish to reflective layer 250.

With reference now to FIG. 2B, faceplate 105 is exposed to a high temperature (e.g., it is baked in an oven) so that lacquer material 240 evaporates away through pores in reflective layer 250, leaving in the pixel assembly the layers of color filter material 220, phosphor material 230, and reflective layer 250. As indicated in the illustration, reflective layer 250 is also located over the side wall and top surface of black matrix 110.

The prior art is problematic because the lacquer material is applied over the entire surface of the inside surface of the faceplate. Thus, the entire surface area of the layer of lacquer material is exposed to particulates in the surrounding atmosphere before the reflective layer is applied. These particulates settle on the surface of the lacquer material and introduce imperfections into the surface of the reflective layer. For example, particles protruding from the surface of the lacquer material could cause pitting in the reflective layer. The imperfections in the reflective layer diminish the mirror surface of the reflective layer and hence reduce the reflective capability of the mirror surface.

Another disadvantage to the prior art is that the imperfections caused by the particulates in the lacquer material can result in weak spots in the reflective layer. For example, the pitting caused by particles creates areas where the reflective layer is thinner, and these areas may significantly weaken the reflective layer, especially considering the thinness of the reflective layer. During operation of the field-emission display device, the reflective layer is subjected to significant electrostatic loads due to the electrical potential that exists between the electron emitters (i.e., the cathode) and the reflective layer (i.e., the anode). The electrostatic loads exert a pulling force on the reflective layer that can cause it to break or tear apart at weak spots. A tear in the reflective layer reduces the reflective capability of the mirror surface. In addition, a tear in the reflective layer creates stringers of aluminum that induce arcing between the electron emitters and the faceplate. This arcing dims the pixel assembly by damaging it or by reducing the flow of electrons into it, and thus the quality of the display is reduced. If the damage is extensive, it may be necessary to replace the faulty portion of the field-emission display device. This causes added costs to either the manufacturer or the owner of the field-emission display device, and also causes inconvenience and loss of productivity during the period of time when the device is being repaired and is unavailable.

The prior art is also problematic because, as described above, the lacquer material is applied over the black matrix as well as the pixel assemblies. With reference back to FIG. 2A, the lacquer material drapes over the side wall of pixel assembly 115, but it doesn't drape over cleanly, leaving a gap 216 between lacquer material 240 and black matrix 110. Alternatively, lacquer material 240 may thicken in the area (indicated by 217) between phosphor material 230 and black matrix 110. With reference now to FIG. 2B, when the lacquer material is evaporated away, gaps 216 and 217 will be formed between reflective layer 250 and black matrix 110 and between reflective layer 250 and phosphor material 230, respectively. These gaps, also referred to as "tenting," prevent reflective layer 250 from properly adhering to phosphor material 230 and black matrix 110 where the tenting occurs. In addition, the adhesion of reflective layer 250 to the side wall and top surface of black matrix 110 is reduced by the lacquer material applied to those surfaces. Although lacquer material 240 is evaporated away, it initially forms a barrier between black matrix 110 and reflective layer 250 that can reduce adhesion. Without proper adhesion between the reflective layer and the supporting surfaces, the capability of the reflective layer to withstand the pulling forces introduced by the electrostatic loads is reduced and creates weak spots in the reflective layer, especially considering the thinness of the reflective layer. As discussed above, a weak spot in the reflective layer can cause it to tear or break apart, thus reducing the quality of the display.

Thus, a need exists for a method for fabricating a pixel assembly on a faceplate of a field-emission display device wherein the method reduces the wastage and time associated with the application of the color filter and phosphor materials. A need also exists for a method that improves the adhesion of the reflective layer to the black matrix. A further need exists for a method that addresses that need and also reduces or eliminates the imperfections and weak spots introduced in the reflective layer that are associated with the application of the lacquer material.

SUMMARY OF INVENTION

The present invention provides a method for fabricating a pixel assembly on a faceplate of a display device (e.g., a field-emission display device) wherein the method reduces the wastage and time associated with the application of the color filter and phosphor materials. The present invention also provides a method that improves the adhesion of the reflective layer to the black matrix. The present invention also provides a method that reduces or eliminates the imperfections and weak spots introduced in the reflective layer that are associated with the application of the lacquer material.

Specifically, in one embodiment of the present invention, an application device is aligned over a pixel assembly on a faceplate. The present invention dispenses a specific amount of a substance into the pixel assembly such that the substance is dispensed primarily into the pixel assembly and such that the substance is not substantially dispensed outside of the pixel assembly. The present invention dispenses the substance into the pixel assembly such that the substance is not dispensed on a top surface of a matrix structure, where the matrix structure separates rows and columns of adjacent pixel assemblies. In one embodiment, the substance is dispensed into the pixel assembly from a printer head adapted to dispense the substance. The substance is selected from a group consisting of: a color filter material, a phosphor material, a wetting material, a lacquer material, and a reflective layer material.

In another embodiment of the present invention, a first substance is dispensed from a first application device into a first pixel assembly, a second substance is dispensed from a second application device into a second pixel assembly, and a third substance is dispensed from a third application device into a third pixel assembly. The substance is selected from a group consisting of: a color filter material, a phosphor material, a wetting material, a lacquer material, and a reflective layer material.

In yet another embodiment of the present invention, a color filter material is dispensed from a first application device, a phosphor material is dispensed from a second application device, and a lacquer material is dispensed from a third application device.

In still another embodiment of the present invention, a similar substance is dispensed from each of a first, second and third application device, where a first color of the similar substance is dispensed from the first application device, a second color of the similar substance is dispensed from the second application device, and a third color of the similar substance is dispensed from the third application device.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention.

PRIOR ART

PRIOR ART

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. Although the present invention will be described in the context of a field-emission display device, various modifications to the preferred embodiment will be readily apparent to those skilled in the art, and the generic principles herein may be applied to other embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
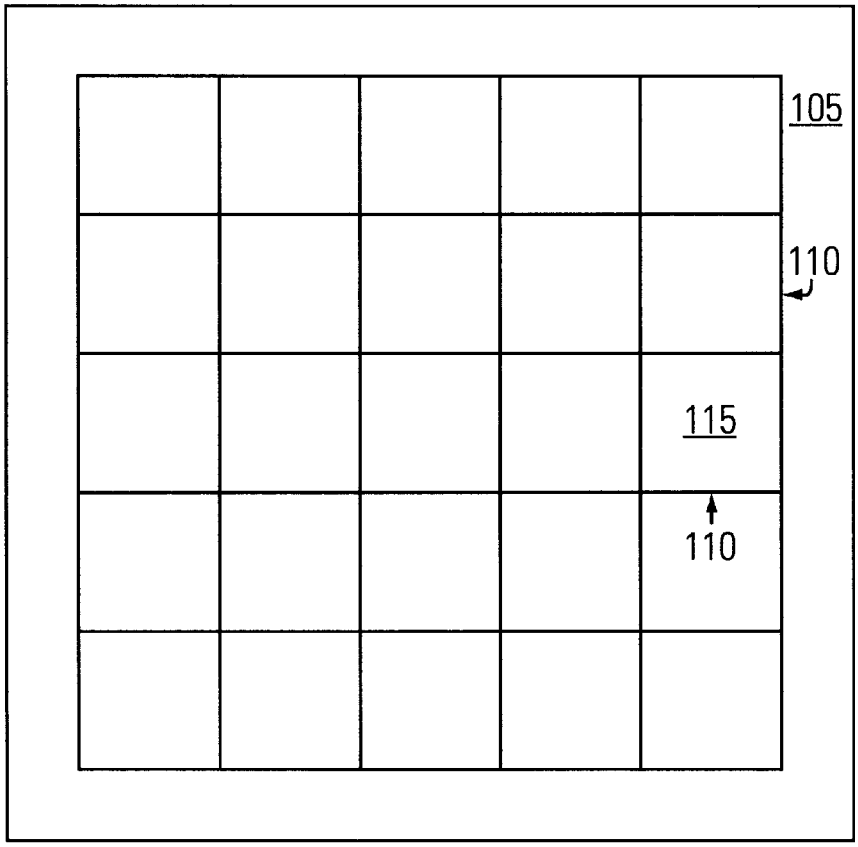
FIG. 1 (Prior Art)
FIG. 1 is a top view of the inside surface of a conventional faceplate of a field-emission display device showing an arrangement of pixel assemblies.
Figure 2A:
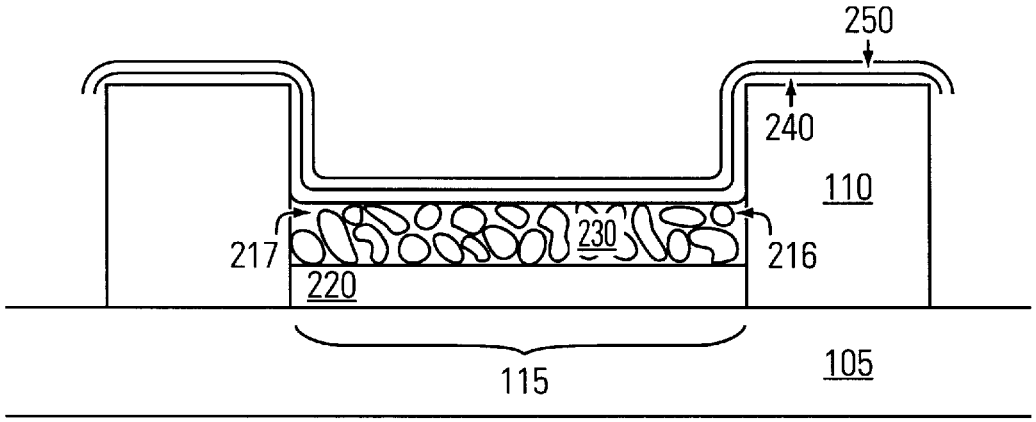
FIG. 2A (Prior Art)
FIGS. 2A and 2B are cross-sectional views of a pixel assembly formed on the inside surface of a faceplate of a field-emission display device.
Figure 2B:
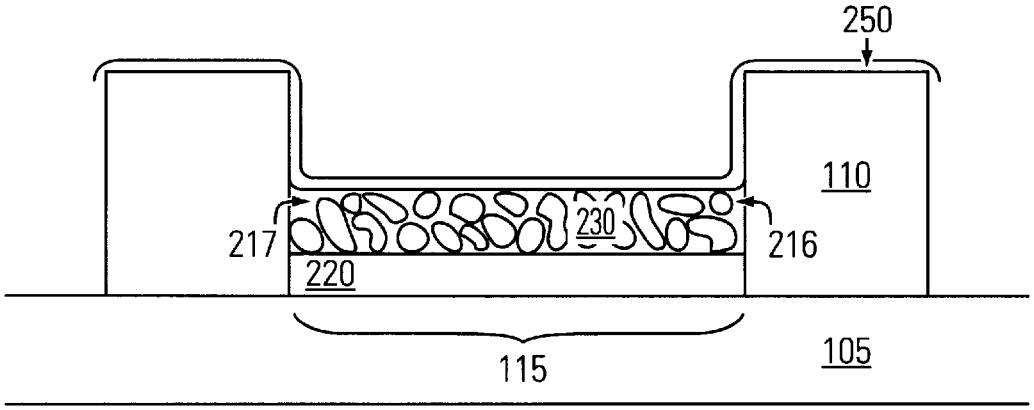
FIG. 2B (Prior Art)
Figure 3A:
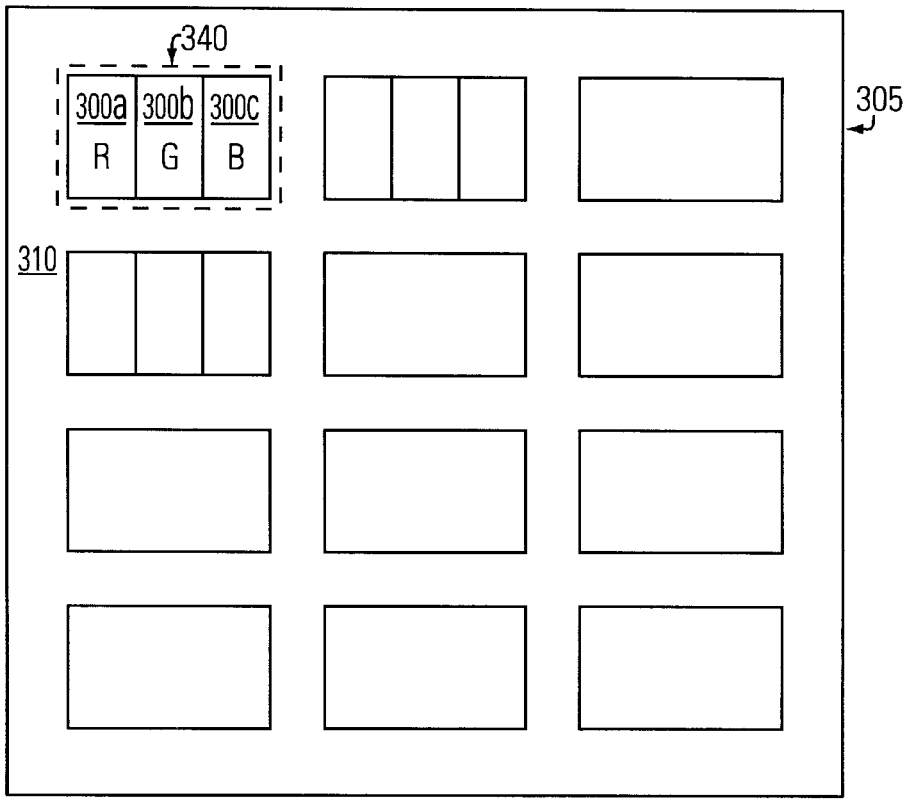
FIGS. 3A and 3B are a top view and cross-sectional view, respectively, of the inside surface of a field-emission display device showing an arrangement of pixel assemblies in accordance with the present claimed invention.

With reference to FIG. 3A, the inside surface of faceplate 305 of a field-emission display device (not shown) contains a plurality of pixels exemplified by pixel 340. For a typical color display, each pixel 340 contains three pixel assemblies exemplified by pixel assemblies 300*a,* 300*b* and 300*c*. For a monochrome display, each pixel is not broken down into pixel assemblies. Each color pixel 340 contains a red (R) pixel assembly 300*a,* a green (G) pixel assembly 300*b,* and a blue (B) pixel assembly 300*c*. The pixel assemblies are aligned in rows and columns on faceplate 305 and are separated by black matrix 310, where the term "black" refers to the low reflectivity and opaque characteristic of the matrix.

Figure 3B:
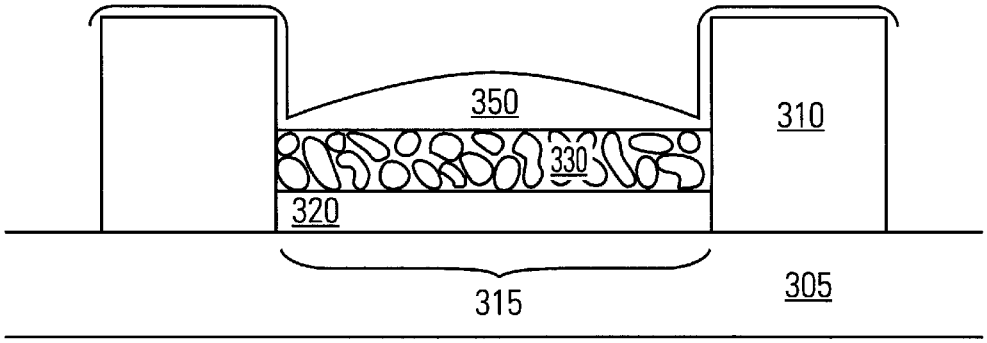

With reference next to FIG. 3B, a cross-sectional view of exemplary pixel assembly 315 on faceplate 305 is shown in accordance with the present invention. The walls formed by black matrix 310 contain pixel assembly 315. In actuality, black matrix 310 surrounds each pixel assembly on all four sides as shown by FIG. 3A.

In the embodiment shown in FIG. 3B, within each pixel assembly 315 is a layer of phosphor material 330 comprised of phosphor particles of irregular size and shape. In one embodiment of a pixel assembly, a layer of color filter material 320 is located between phosphor material 330 in pixel assembly 315 and faceplate 305. Reflective layer 350 is located above phosphor material 330. As shown in FIG. 3B, reflective layer 350 covers the side walls and the top surfaces of black matrix 310 and continues into adjacent pixel assemblies.

The present invention provides a method for fabricating pixel assemblies on faceplates of field-emission display devices. The present invention provides a method for dispensing color filter materials and phosphor materials into the pixel assemblies. The present invention also provides a method for wetting the phosphor materials and dispensing a lacquer material into the pixel assemblies. The present embodiment of the present invention uses an application device adapted from an ink-jet printer head to apply the color filter, phosphor, wetting, and lacquer materials. It is understood that the present invention will also work with an application device adapted from other types of printer heads such as bubble jet printer heads. The present invention also provides a method for applying a reflective layer to the field-emission display device.

Figure 4A:
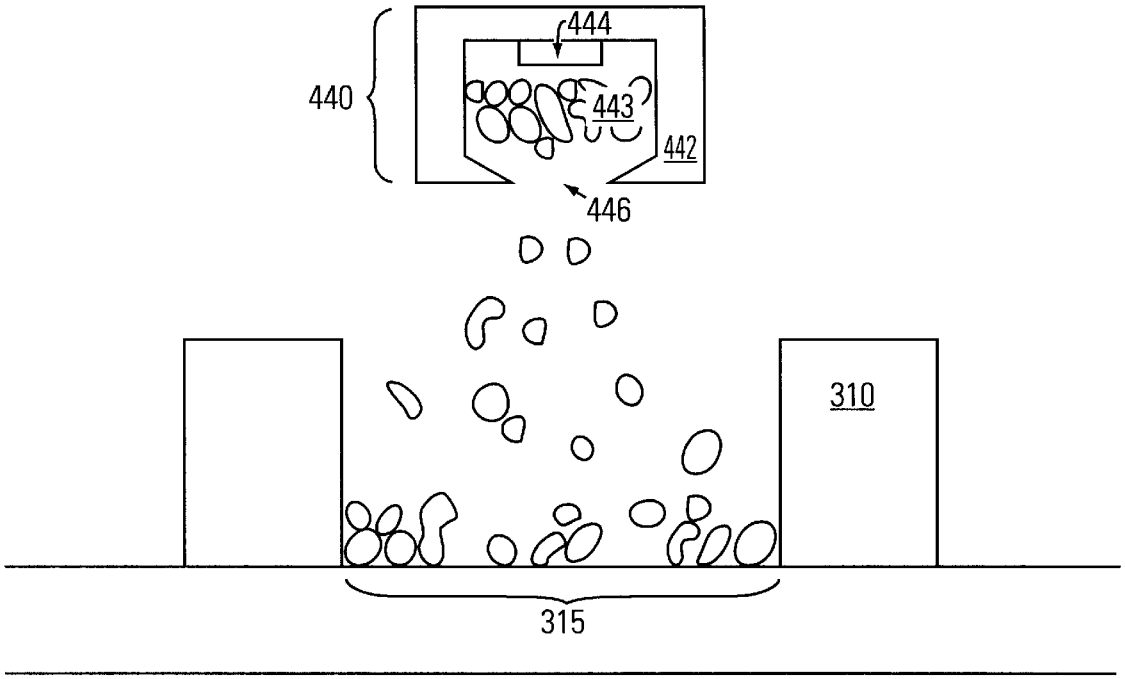
FIGS. 4A and 4B are illustrations of an application device for dispensing a substance into a pixel assembly in accordance with one embodiment of the present claimed invention.

With reference to FIG. 4A, one embodiment of an application device for applying the color filter, phosphor, wetting, lacquer, and reflective layer materials in accordance with the present invention is shown. Application device 440 is comprised of housing 442 for containing substance 443 that is to be dispensed (e.g., the color filter, phosphor, wetting, lacquer, or reflective material). A driver 444 is coupled to housing 442 in order to move substance 443 through nozzle 446. In one embodiment, driver 444 is a thermal device used to heat substance 443 to create pressure for forcing substance 443 through nozzle 446. In another embodiment, driver 444 is a piezo-electric device that functions in a similar manner to heat substance 443 to create pressure for forcing substance 443 through nozzle 446.

Continuing with reference to FIG. 4A, application device 440 is positioned over pixel assembly 315 so that substance 443 is dispensed directly into pixel assembly 315. In the present embodiment, application device 440 is designed with sufficient precision to dispense a specific volume of substance 443 through nozzle 446 during the period of time in which driver 444 is activated, such that the dispensed volume results in a layer of substance 443 that is of the desired thickness in pixel assembly 315. Nozzle 446 is also designed to dispense substance 443 into an area smaller than pixel assembly 315; that is, the resolution of application device 440 is sufficiently precise so that substance 443 is dispensed primarily into and not substantially outside of pixel assembly 315. In the present embodiment, application device 440 is sufficiently precise such that substance 443 is not dispensed on the side wall (except where a layer of substance 443 is in physical contact with the side wall) and top surface of black matrix 310.

In one embodiment, application device 440 is an ink-jet printer head adapted to dispense substance 443. A typical pixel assembly 315 is approximately 70 microns by 200 microns in size. The typical resolution of ink-jet printer heads is approximately 30 microns. Thus, an ink-jet printer head adapted to dispense color filter, phosphor, wetting, lacquer, or reflective material achieves the precision required in accordance with the present invention. In alternative embodiments, other types of printer heads (e.g., bubble jet printer heads) adapted to dispense substance 443 can be used in accordance with the present invention.

Figure 4B:
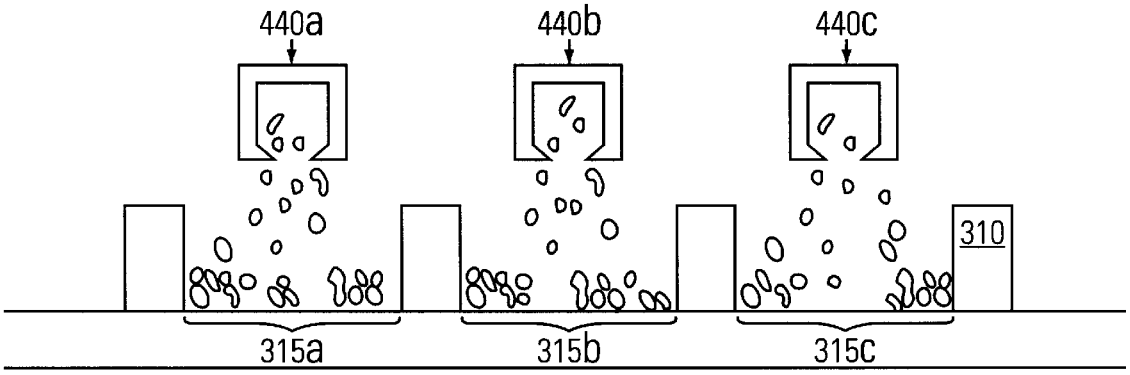

With reference to FIG. 4B, in one embodiment of the present invention, a plurality of application devices 440*a,* 440*b* and 440*c* function concurrently to dispense a substance into each of pixel assemblies 315*a,* 315*b* and 315*c*. In FIG. 4B, three application devices dispensing into three pixel assemblies are illustrated; however, it is appreciated that a number of application devices different than three can be used to concurrently dispense substances into an equal number of pixel assemblies in accordance with the present invention.

Continuing with reference to FIG. 4B, in one embodiment, application devices 440*a,* 440*b* and 440*c* each dispense a substance in any combination from the group consisting of the following substances: a color filter material (red, blue or green), a phosphor material (red, blue or green), a wetting material (e.g., water), a lacquer material, and a reflective layer material. In one embodiment, more than one of application devices 440*a,* 440*b* and 440*c* dispense the same substance, such as one specified color (e.g., red) of one specified substance (e.g., phosphor material). In one embodiment, each application device 440*a,* 440*b* and 440*c* dispenses a similar substance. For example, application device 440*a* dispenses red phosphor material, application device 440*b* dispenses blue phosphor material, and application device 440*c* dispenses green phosphor material.

In one embodiment, each application device 440*a,* 440*b* and 440*c* of FIG. 4B is used to dispense a different substance. For example, application device 440a dispenses red phosphor material, application device 440*b* dispenses water, and application device 440*c* dispenses lacquer material.

In the manner described above, the present invention selectively applies a substance only into the pixel assembly where the substance is intended to remain. Thus, the present invention addresses the problem of wastage associated with the prior art. In addition, by using a plurality of application devices to concurrently apply materials to a plurality of pixel assemblies, the present invention reduces the time required to form pixels.

Figure 5:
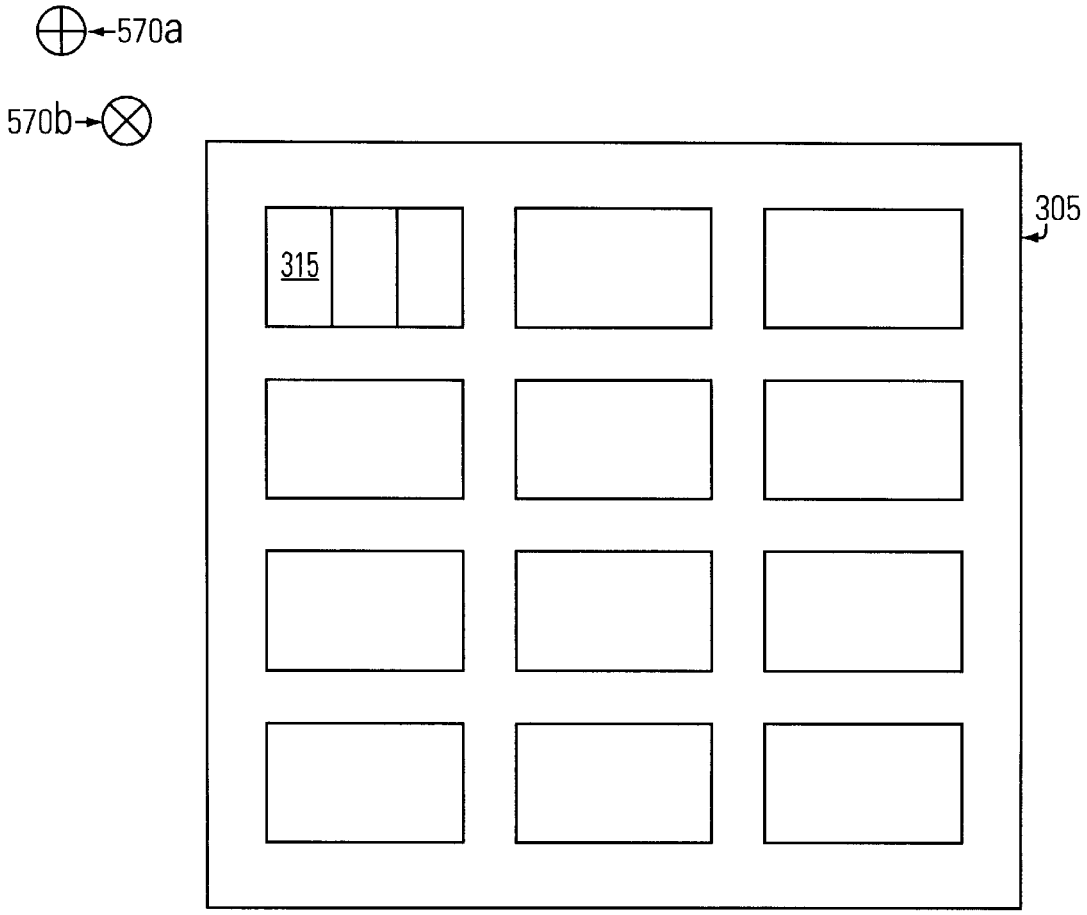
FIG. 5 is an illustration of a method for aligning an application device in accordance with one embodiment of the present claimed invention.

With reference now to FIG. 5, application device 440 of FIG. 4 is oriented relative to faceplate 305 using an alignment device (not shown) that is known and practiced in the art. The alignment devices that are known and practiced in the art provide the degree of precision required by the present invention. In one embodiment, application device 440 incorporates a machine vision system (e.g., a camera) that optically aligns the application device with fiducials 570*a* and 570*b*. Faceplate 305 is placed in a predetermined position that is known relative to the position of fiducials 570*a* and 570*b*. Thus, when the machine vision system is aligned with fiducials 570*a* and 570*b,* the orientation of application device 440 is known relative to the location of faceplate 305. In one embodiment, application device 440 is then moved a predetermined distance based on the dimensions of pixel assembly 315 and faceplate 305, so that application device 440 is aligned precisely over pixel assembly 315. Subsequent movements of application device 440 to other pixel assemblies are based on the faceplate and pixel assembly dimensions. In another embodiment, application device 440 remains stationary, and faceplate 305 is moved a predetermined distance based on the dimensions of faceplate 305 and pixel assembly 315 to align pixel assembly 315 under the application device.

With reference to FIGS. 6A through 6F, a process for fabricating a pixel assembly in accordance with one embodiment of the present invention is illustrated. Each of FIGS. 6A through 6F illustrate a step in the process. Different embodiments of the present invention may utilize some or all of the steps in the process of the present embodiment. That is, the present invention is not limited to utilizing all of the steps in the process. Thus, one substance may be dispensed into a pixel assembly in accordance with the present invention, and another substance may be dispensed using an alternative method.

Figure 6A:
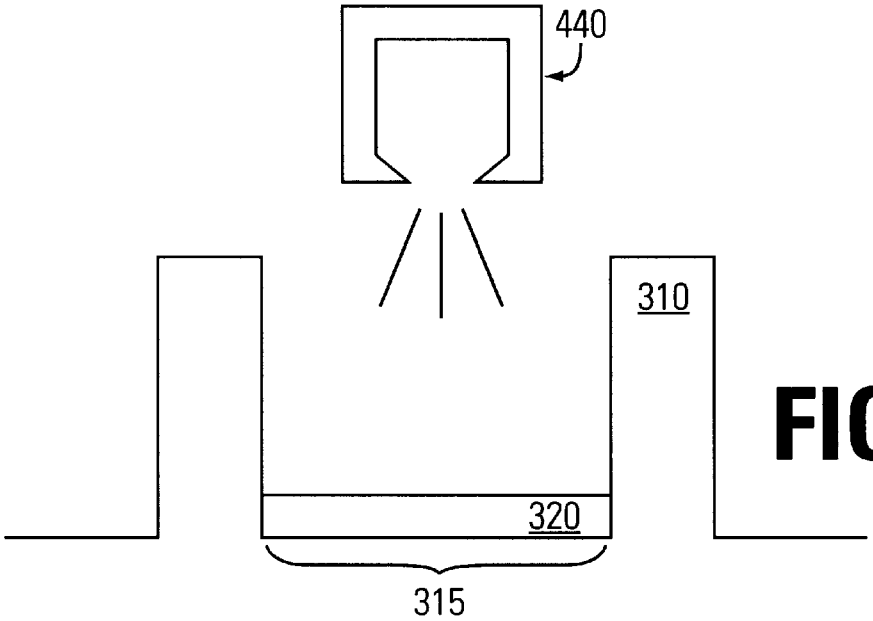
FIGS. 6A through 6F are illustrations of a cross-section of a pixel assembly showing the method for fabricating a pixel assembly in accordance with one embodiment of the present claimed invention.

With reference first to FIG. 6A, in one embodiment, color filter material 320 (red, blue or green) is dispensed into pixel assembly 315 from application device 440. Application device 440 dispenses a specified amount of color filter material 320 such that a layer of a desired thickness of color filter material 320 is formed in pixel assembly 315. In accordance with the present invention, color filter material 320 is dispensed primarily into pixel assembly 315 and is not dispensed on the top surface of black matrix 310.

Figure 6B:
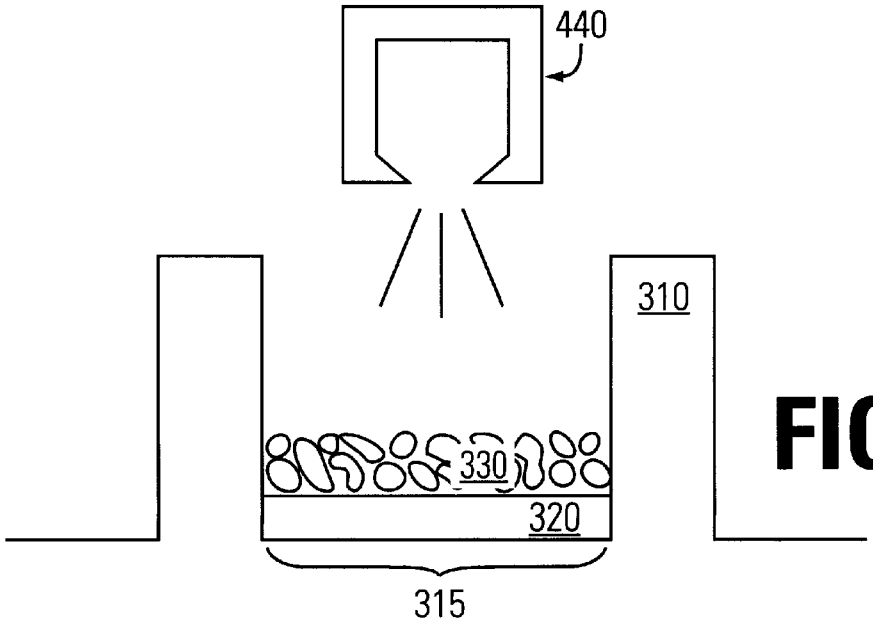

With reference next to FIG. 6B, in the present embodiment, phosphor material 330 (red, blue or green) is dispensed into pixel assembly 315 from application device 440. Application device 440 dispenses a specified amount of phosphor material such that a layer of a desired thickness of phosphor material 330 is formed in pixel assembly 315. In accordance with the present invention, phosphor material 330 is dispensed primarily into pixel assembly 315 and is not dispensed on the top surface of black matrix 310.

Figure 6C:
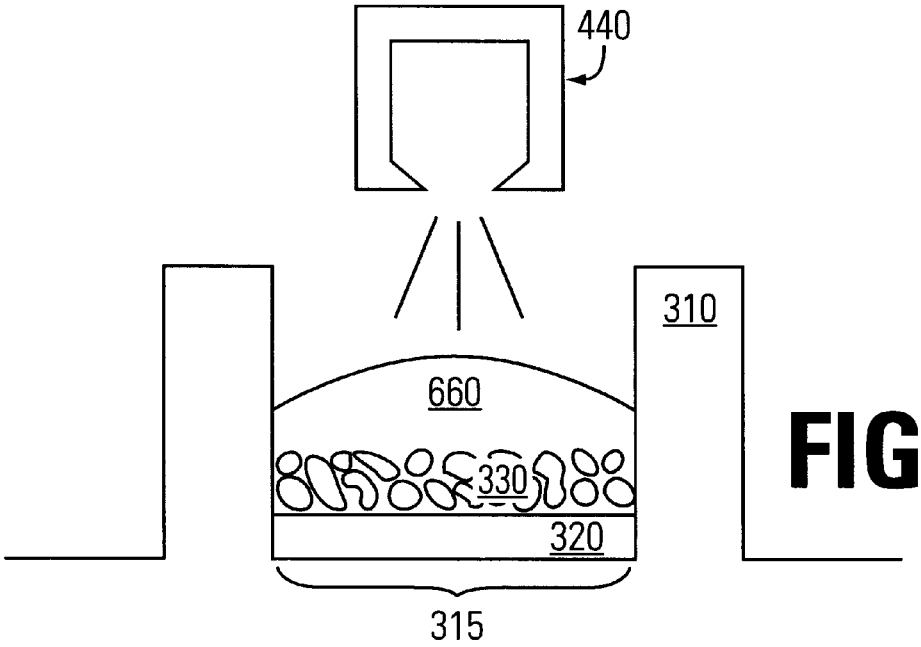

With reference to FIG. 6C, in this embodiment, phosphor material 330 is wetted with a wetting material (e.g., water) to form a smooth surface (i.e., wetted layer 660) over which, later in the process, lacquer material will be applied in accordance with the present invention. Phosphor material 330 consists of irregularly shaped and sized particles that form a relatively uneven surface. In accordance with the present invention, a predetermined amount of water is dispensed into pixel assembly 315 from application device 440. Sufficient water is dispensed to fill the gaps between the particles of phosphor material 330 and form a smooth water surface above the highest point of the phosphor material. In one embodiment, wetted layer 660 forms a meniscus that is rounded such that the surface of the water is concave toward faceplate 305. As will be seen below, the shape of the wetted layer determines the shape of the reflective layer applied later in the process. A concave shape for the reflective surface is advantageous because it maximizes the amount of light reflected toward the viewer through faceplate 305, and minimizes the amount of light reflected toward black matrix 310.

Figure 6D:
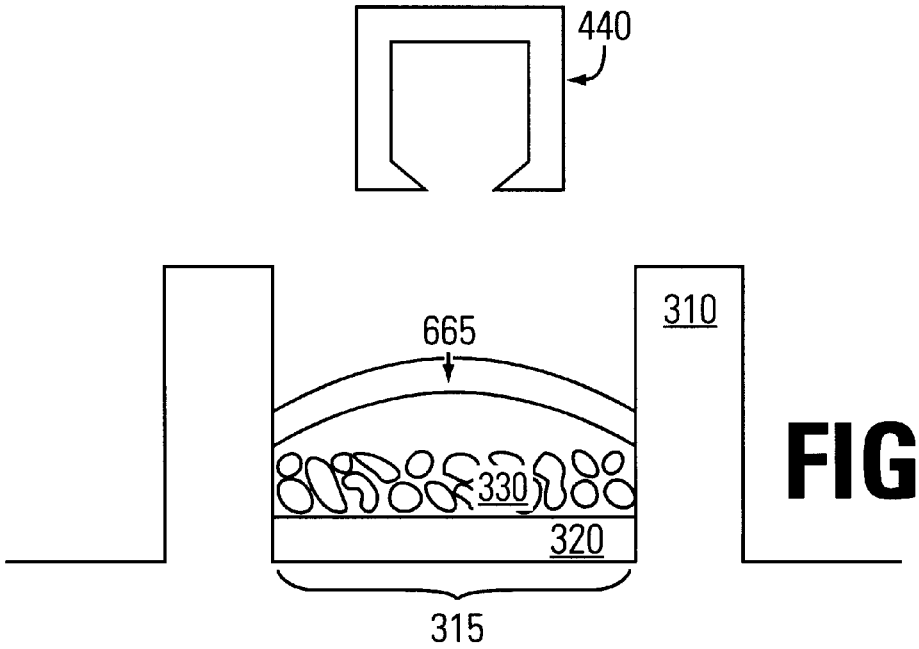

With reference to FIG. 6D, in this embodiment, lacquer material 665 is dispensed into pixel assembly 315 from application device 440. Application device 440 dispenses a specified amount of lacquer material such that a layer of a desired thickness of lacquer material 665 is formed over wetted layer 660 in pixel assembly 315. Lacquer material 665 assumes the shape of wetted layer 660; thus, if wetted layer 660 is concave toward faceplate 305 as described above, lacquer material 665 is also concave toward faceplate 305. In accordance with the present invention, lacquer material 665 is dispensed primarily into pixel assembly 315 and is not dispensed on the side walls and top surface of black matrix 310. Thus, lacquer material 665 does not drape over the side of black matrix 310, and thus the present invention reduces or eliminates the gaps that form between the lacquer material and the black matrix as a result of tenting.

After lacquer material 665 is dispensed into each of the pixel assemblies, the field-emission display device is baked at a selected temperature for a selected period of time in order to evaporate wetted layer 660. In one embodiment, the bake temperature is less than 100 degrees (Centigrade) and the bake time is approximately one-half to one hour. Wetted layer 660 evaporates and diffuses through lacquer material 665. The baking also serves to harden lacquer material 665.

Figure 6E:
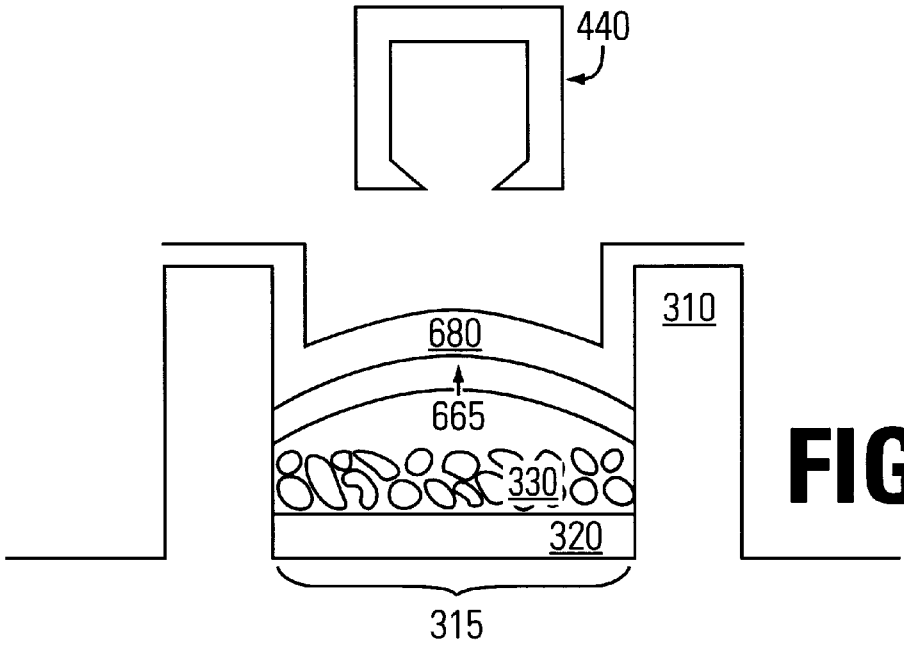

With reference next to FIG. 6E, in this embodiment, reflective layer 680 is formed over the layer formed by lacquer material 665. Reflective layer 680 assumes the shape of the layer formed by lacquer material 665. Thus, a concave meniscus formed by wetted layer 660 results in a reflective layer 680 that is also concave.

Reflective layer 680 is also formed over the side walls and top surfaces of black matrix 310. However, as described above, the lacquer material is not dispensed onto the side walls and top surfaces of black matrix 310, so there is no lacquer material between the reflective layer (e.g., the aluminum) and the black matrix. Thus, reflective layer 680 is in direct contact with black matrix 310. As such, reflective layer 680 adheres better to black matrix 310. Hence, the present invention reduces the need to rework field-emission display devices during the manufacturing process in order to correct inadequate adhesion. In addition, the present invention reduces the incidence of aluminum stringers caused when the aluminum tears at points where it is not adequately adhered to the black matrix. Therefore, the present invention improves the reliability and yield of field emission display devices.

In one embodiment, reflective layer 680 is formed using techniques known and practiced in the art, such as physical vapor deposition. In one embodiment, reflective layer 680 is formed by dispensing a reflective material through application device 440.

Figure 6F:
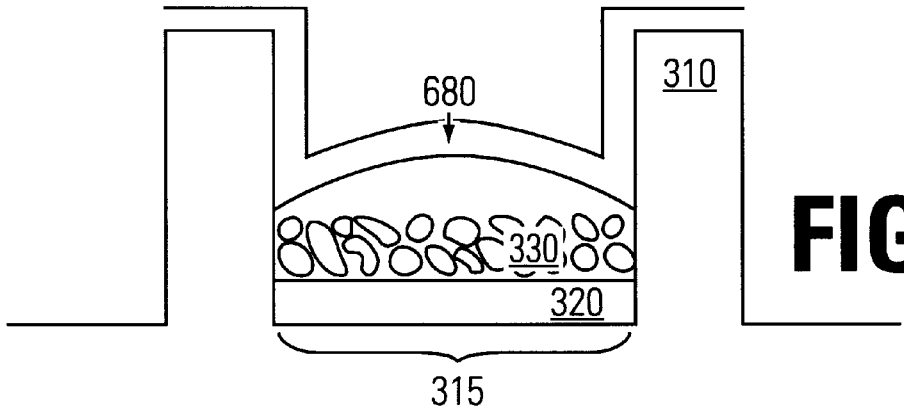

With reference now to FIG. 6F, the field-emission display device is baked to evaporate lacquer material 665. Lacquer material 665 diffuses through reflective layer 680 and is exhausted from the baking oven. Because lacquer material 665 is not applied to the side walls and top surfaces of black matrix 310 in accordance with the present invention, reflective layer 680 is in direct contact with the black matrix and so is able to properly adhere to the black matrix. Thus, the present invention improves the adhesion of the reflective layer to the black matrix. In addition, as described above in conjunction with FIG. 6D, the present invention reduces or eliminates the gaps that form between the lacquer material and the black matrix as a result of tenting. Hence, the present invention reduces or eliminates the imperfections and weak spots in reflective layer 680 that are associated with the prior art due to tenting.

With reference back to FIG. 6A, in another embodiment, as one color of color filter material 320 is dispensed from an application device into one pixel assembly, the same color is dispensed concurrently from other application devices into other pixel assemblies designated to receive that color. In another embodiment, different colors of color filter material are concurrently dispensed from other application devices into other pixel assemblies according to the color designated for each pixel assembly. Also, in still another embodiment, concurrent with the dispensing of color filter material into some pixel assemblies, other pixel assemblies that have already received a color filter material can receive another substance dispensed from other application devices.

With reference back to FIG. 6B, in another embodiment, as one color of phosphor material 330 is dispensed from an application device into one pixel assembly, the same color is dispensed concurrently from other application devices into other pixel assemblies designated to receive that color. In another embodiment, different colors of phosphor material are concurrently dispensed from other application devices into other pixel assemblies according to the color designated for each pixel assembly. Also, in still another embodiment, concurrent with the dispensing of phosphor material into some pixel assemblies, other pixel assemblies that have already received a phosphor material can receive another substance dispensed from other application devices.

With reference back to FIG. 6D, in another embodiment, one application device 440 dispenses water into pixel assembly 315, and another application device immediately follows and dispenses lacquer material into the same pixel assembly. In this embodiment, a plurality of such application devices work in tandem to efficiently dispense wetted layer 660 and lacquer material 665 in all pixel assemblies in the field-emission display device.

In summary, in one embodiment, the present invention provides a method for fabricating pixel assemblies on a faceplate of a field-emission display device. The method of the present embodiment reduces the wastage and time associated with the application of the color filter and phosphor materials. The present embodiment also provides a method that improves the adhesion of the reflective layer to the black matrix. The present embodiment also provides a method that reduces or eliminates the imperfections and weak spots introduced in the reflective layer that are associated with the application of the lacquer material.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications are suited to the particular use contemplated. It is intended that the scope of the invention be defined by the claims appended hereto and their equivalents.

What is claimed is:

1. A method for fabricating a pixel assembly on a faceplate of a field-emission display device, said method comprising:

a) aligning an application device over said pixel assembly on said faceplate; and b) dispensing a specific amount of a substance from said application device into said pixel assembly such that said substance is dispensed primarily into said pixel assembly and such that said substance is not substantially dispensed outside of said pixel assembly.

2. The method as recited in claim 1 further comprising dispensing said substance into said pixel assembly from an application device comprising:

a housing for containing said substance;

a nozzle located on said housing for directing said substance from said housing into said pixel; and a driver coupled to said housing for causing said substance to move through said nozzle.

3. The method as recited in claim 1 further comprising dispensing said substance into said pixel assembly from a printer head adapted to dispence said substance.

4. The method as recited in claim 1 wherein said substance is selected from a group consisting of: a color filter material, a phosphor material, a wetting material, a lacquer material, and a reflective layer material.

5. The method as recited in claim 1 further comprising dispensing said substance into said pixel assembly such that said substance is not dispensed on a top surface of a matrix structure, said matrix structure separating rows and columns of adjacent ones of said pixel.

6. The method as recited in claim 1 further comprising dispensing a plurality of substances from a plurality of application devices into a respective plurality of pixel assemblies.

7. The method as recited in claim 6 wherein said plurality of substances are selected from a group consisting of: a color filter material, a phosphor material, a wetting material, a lacquer material, and a reflective layer material.

8. The method as recited in claim 7 further comprising dispensing a different substance from each of said plurality of application devices.

9. The method as recited in claim 7 further comprising dispensing a similar substance from each of said plurality of application devices.

10. The method as recited in claim 7 further comprising dispensing a same substance from each of said plurality of application devices.

11. A method for fabricating a pixel assembly on a faceplate of a field-emission display device, said method comprising:

a) aligning an application device over said pixel assembly; and b) dispensing a specific amount of a lacquer material from said application device into said pixel assembly such that said lacquer material is dispensed primarily into said pixel assembly and such that said lacquer material is not substantially dispensed outside of said pixel assembly.

12. The method as recited in claim 11 further comprising dispensing said lacquer material into said pixel assembly from an application device comprising:

a housing for containing said lacquer material;

a nozzle located on said housing for directing said lacquer material from said housing into said pixel assembly; and a driver coupled to said housing for causing said lacquer material to move through said nozzle.

13. The method as recited in claim 11 further comprising dispensing said lacquer material into said pixel assembly from a printer head adapted to dispense said lacquer material.

14. The method as recited in claim 11 wherein step b) further comprises dispensing said lacquer material into said pixel assembly such that said lacquer material is not dispensed on a top surface of a matrix structure, said matrix structure separating rows and columns of adjacent ones of said pixel assembly.

15. The method as recited in claim 11 wherein step b) further comprises dispensing a color filter material from an application device into said pixel assembly, wherein said color filter material is dispensed before said lacquer material is dispensed, such that said color filter material is dispensed primarily into said pixel assembly and such that said color filter material is not substantially dispensed outside of said pixel assembly.

16. The method as recited in claim 11 wherein step b) further comprises dispensing a phosphor material from an application device into said pixel assembly, wherein said phosphor material is dispensed before said lacquer is dispensed, such that said phosphor material is dispensed primarily into said pixel assembly and such that said phosphor material is not substantially dispensed outside of said pixel assembly.

17. The method as recited in claim 11 wherein step b) further comprises dispensing a wetting material from an application device into said pixel assembly, wherein said wetting material is dispensed before said lacquer is dispensed, such that said wetting material is dispensed primarily into said pixel assembly and such that said wetting material is not substantially dispensed outside of said pixel assembly.

18. The method as recited in claim 17 wherein said wetting material is dispensed to form a concave surface, such that said concave surface is concave toward said faceplate.

19. The method as recited in claim 11 further comprising the step of:

c) applying a specific amount of a reflective layer material over said lacquer material.

20. An apparatus for fabricating a pixel assembly on a faceplate of a field-emission display device, said apparatus comprising:

an application device adapted to dispense a specific amount of a substance from said application device into said pixel assembly on said faceplate such that said substance is dispensed primarily into said pixel assembly and such that said substance is not substantially dispensed outside of said pixel assembly; and an alignment device coupled to said application device, said alignment device adapted to dispose said application device over said pixel assembly in an initial location and in an initial orientation, said initial location and said initial orientation known relative to a surface of said field-emission display device.

21. The apparatus of claim 20 wherein said application device further comprises:

a housing for containing said substance;

a nozzle located on said housing for directing said substance from said housing into said pixel assembly; and a driver coupled to said housing for causing said substance to move through said nozzle.

22. The apparatus of claim 20 wherein said application device is an printer head adapted to dispense said substance.

23. The apparatus of claim 20 wherein said application device is adapted to dispense said substance into said pixel assembly such that said substance is not dispensed on a top surface of a matrix structure, said matrix structure separating rows and columns of adjacent ones of said pixel assembly.

24. The apparatus of claim 20 wherein said application device is adapted to dispense said substance selected from a group consisting of: a color filter material, a phosphor material, a wetting material, a lacquer material, and a reflective layer material.

25. The apparatus of claim 22 wherein said alignment device further comprises a machine vision system adapted to align said application device with a set of fiducials, wherein said set of fiducials is in a known location and in a known orientation relative to said surface of said field-emission display.

* * * * *